US009636806B1

(12) United States Patent
Lee et al.

(10) Patent No.: US 9,636,806 B1
(45) Date of Patent: May 2, 2017

(54) MULTIPLE SIZE NUT DRIVER

(71) Applicants: David M. Lee, Westminster, CA (US); Mike Zwiesler, Pasadena, CA (US)

(72) Inventors: David M. Lee, Westminster, CA (US); Mike Zwiesler, Pasadena, CA (US)

( * ) Notice: Subject to any disclaimer, the term of this patent is extended or adjusted under 35 U.S.C. 154(b) by 477 days.

(21) Appl. No.: 14/504,294

(22) Filed: Oct. 1, 2014

Related U.S. Application Data

(63) Continuation-in-part of application No. 14/275,411, filed on May 12, 2014, now Pat. No. 9,573,252.

(51) Int. Cl.

| | |
|---|---|
| ***B25B 13/00*** | (2006.01) |
| ***B25B 13/10*** | (2006.01) |
| ***B25B 13/06*** | (2006.01) |
| *B25B 23/00* | (2006.01) |
| *B25B 23/16* | (2006.01) |

(52) U.S. Cl.
CPC ..... *B25B 13/102* (2013.01); *B25B 13/06* (2013.01); *B25B 23/0035* (2013.01); *B25B 23/16* (2013.01)

(58) Field of Classification Search
CPC ..... B25B 13/102; B25B 13/105; B25B 13/06; B25B 23/16
USPC ..... 81/124.5
See application file for complete search history.

(56) References Cited

U.S. PATENT DOCUMENTS

| | | | | |
|---|---|---|---|---|
| 1,346,061 | A | 7/1920 | Rosenberg | |
| 1,896,949 | A | 2/1933 | Greiner | |
| 3,285,106 | A | 11/1966 | Svenson | |
| 6,330,844 | B1 | 12/2001 | Walker | |
| 6,467,379 | B1 | 10/2002 | Wizman | |
| 6,637,298 | B1 * | 10/2003 | O'Brien | B25B 13/102 81/185 |
| 6,732,615 | B2 * | 5/2004 | Layaou | B25B 13/102 81/124.5 |
| 7,150,209 | B1 | 12/2006 | Loomis | |

OTHER PUBLICATIONS

Select-a-Socket Multi Wrench, sold by GadgetsGo.com, http://gadgetsgo.com/Multiple-head-socket-ratchet-tool.html, and https://www.youtube.com/watch?v=VetyKs62k6l, Jan. 29, 2013.

* cited by examiner

*Primary Examiner* — Bryan R Muller
(74) *Attorney, Agent, or Firm* — Quickpatents, LLC; Kevin Prince

(57) ABSTRACT

A nut driver for driving nuts of various sizes includes an elongated housing with opposing driver and handle ends. The driver end is open and assumes a largest size. A rigid collar and plunger are fixed about the housing and positioned at any of a number of selectable radial positions, each of which is associated with a different nut size. A plurality of nested sockets are each slidably movable by the plunger between forward and rearward positions. Each socket has a foot adapted for contacting the plunger at one of the selectable radial positions. The elongated housing is preferably separated into two sections, including a handle and a two-sided socket mechanism that includes two opposing driver ends each having sockets of different sizes.

18 Claims, 5 Drawing Sheets

MULTIPLE SIZE NUT DRIVER

CROSS-REFERENCE TO RELATED APPLICATIONS

This application is a Continuation-in-Part of U.S. Utility patent application Ser. No. 14/275,411, filed on May 12, 2014, and incorporated herein by reference.

STATEMENT REGARDING FEDERALLY SPONSORED RESEARCH AND DEVELOPMENT

Not Applicable.

FIELD OF THE INVENTION

This invention relates to tools, and more particularly to an adjustable nut driver.

DISCUSSION OF RELATED ART

When using tools, finding a desired socket size for driving a hex nut, bolt, or other type of fastener is sometimes frustrating. Individual sockets often get separated from a set of sockets, resulting in some of the sockets being missing when needed. Further, each socket must be selected, checked for size with the nut, and then returned to the set if not the correct size. The same individual socket may be inadvertently tried several times before the user realizes it, delaying the finishing of the project at hand.

The prior art shows a number of socket-type tools that have nested sockets that slide axially out the way of each other to reveal the correct socket for a particular hex nut, for example. U.S. Pat. No. 1,346,061 to Rosenberg on Jul. 6, 1920 teaches one such device, wherein a plurality of nested sockets can be manually slid forward or rearward to reveal a selected socket. Examples of similar devices include those taught in U.S. Pat. No. 1,896,949 to Greiner on Feb. 7, 1933; U.S. Pat. No. 3,285,106 to Svenson on Nov. 15, 1966; U.S. Pat. No. 6,467,379 to Wizman on Oct. 22, 2002; U.S. Pat. No. 6,637,298 to O'Brien et al. on Oct. 28, 2003, and U.S. Pat. No. 7,150,209 to Loomis et al. on Dec. 19, 2006. With all such devices, the nested sockets are elastically urged forward by a spring mechanism, by gravity, or by direct manual adjustment. Such devices have the inherent problem of even slight mis-alignment with the nut to be rotated both axially and laterally; that is, if the axis of the nut and the axis of the tool are laterally misaligned, then when the tool is applied to the nut the correctly-sized socket will contact the nut unintentionally and be retracted. Likewise, if the socket is not rotationally aligned with the tool, the corners of the hex nut (for example) will also contact the correct socket and cause it to retract. In both cases the selected socket will be too large to properly rotate the nut, or not properly sized so as to damage the nut or the tool itself.

Another prior art device, sold under the brand name "Select-a-Socket" by GadgetsGo.com of Miami Beach, Fla., includes nested sockets that slide axially out the way of each other to reveal the correct socket for a particular hex nut. A selector holds the selected socket and the larger sockets in place, but releases the smaller sockets that are spring-biased into a forward position. With such a device it is not possible to see the selected socket visually since the non-selected sockets are only retracted by pressure from the hex nut. Therefore, if one has difficulty reading the selected size on the side of such a tool, or difficulty imagining the size of a selected socket, the correct size may take some time to discover. Further, the correct rotational orientation of the tool with the bolt head is also more difficult to see when all of the sockets are biased into a forward position.

In my previous U.S. Utility patent application Ser. No. 14/275,411, filed on May 12, 2014, I disclosed a nut driver that overcame all of these disadvantages in the prior art as well as others. However, this earlier nut driver proved not as strong as desired when combining six nested sockets together, each socket wall being relatively thin and prone to failure with overly-tightened nuts.

Therefore, there is a need for a device that includes a number of different socket sizes within a range of sizes, and wherein the socket size may be readily set by the user. Such a needed device would allow the user to sequence through a number of socket sizes in an orderly manner without repeating a particular size inadvertently, until the correct size is found. Such a needed invention would maintain all of the sockets together in one light-weight and relatively inexpensive to manufacture tool, and would replace a typical 5 to 7 piece nut driver set. Further, such a needed device would not allow a non-selected size of socket to be inadvertently retracted due to misalignment of the nut and the tool, and the non-selected sockets would be retracted so that visual discernment of the rotational orientation and the selection of the desired sized sockets would be facilitated. Further, such nested sockets would have relatively thick, strong walls for durability. The present invention accomplishes these objectives.

SUMMARY OF THE INVENTION

The present device is a nut driver for driving a nut within a range of nut sizes all having a consistent perimeter shape. An elongated housing has a driver end and a handle end. The driver end is open and assumes a largest size of the perimeter shape, preferably a hexagon. A rigid collar is fixed about the housing and positioned at any of a number of selectable radial positions, each of which is associated with a different nut size within the range of nut sizes, and positionable between forward and rearward positions.

A plunger is fixed with the collar and adapted to move between the forward position and the rearward position with the collar. A plurality of nested sockets each having the perimeter shape and one of the different nut sizes within the range of nut sizes are each slidably movable by the plunger between the forward position within the open end of the housing, and the rearward position. Each socket has a foot adapted for contacting the plunger at one of the selectable radial positions.

As the collar is turned from one of the selectable radial positions to the next, the plunger is aligned with the foot of one of the sockets. When the collar is then moved to the forward position the plunger pushes the one or more of the outermost nested sockets into the forward position within the open driver end of the housing. A spring mechanism is fixed with each of the sockets and adapted to urge each of the sockets into the rearward position.

In a preferred embodiment, the elongated housing is separated into two sections, including a handle and a two-sided socket mechanism. The handle is selectively detachable from the socket mechanism, the socket mechanism including the collar, plunger and the plurality of nested sockets. The socket mechanism further includes two opposing driver ends, such that the socket mechanism may be positioned with either a first end or the second end engaged with the handle. Each of the two driver ends, includes sockets having different nut sizes.

The present invention is a device that includes a number of different socket sizes within a range of sizes, and wherein the socket size may be readily set by the user. The present device allows the user to sequence through a number of socket sizes in an orderly manner without repeating a particular size inadvertently, until the correct size is found. The present invention maintains all of the sockets together in one light-weight and relatively inexpensive to manufacture tool that is further easy to use and store. Further, the present device provides for the non-selected sockets to be retracted so that visual discernment of the rotational orientation of the tool and the selection of the desired sized sockets is facilitated. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
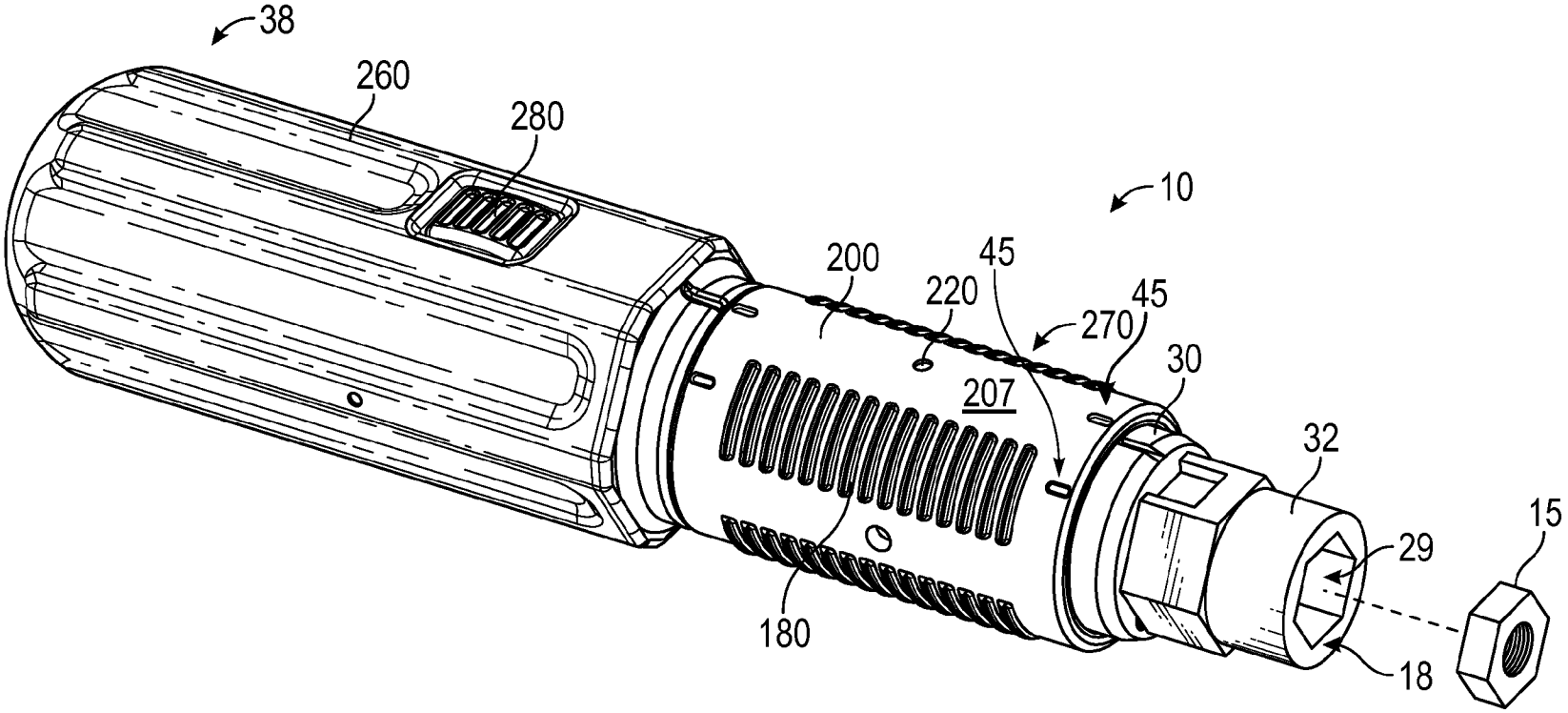
FIG. 1 is a perspective view of a preferred embodiment of the invention.
Figure 2:
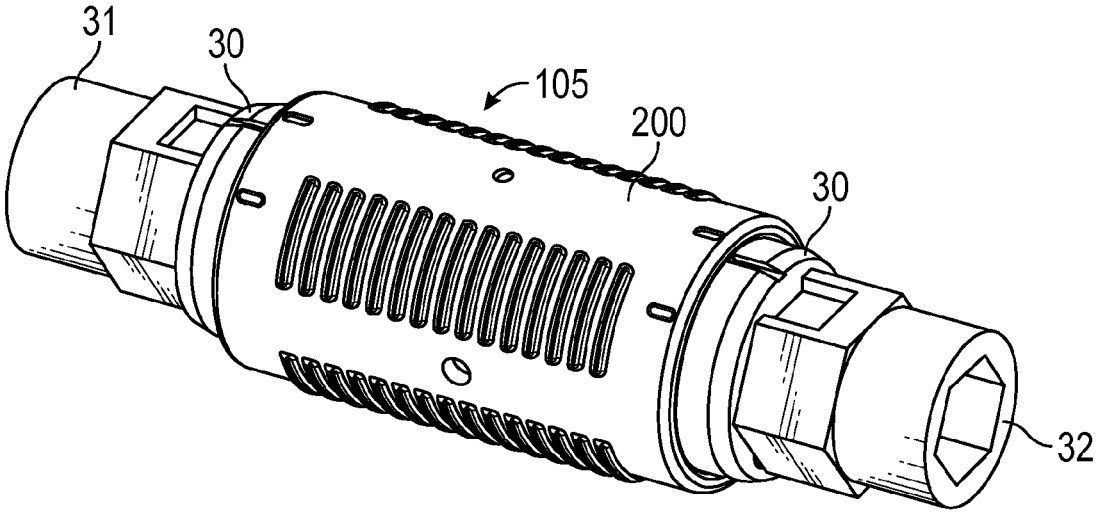
FIG. 2 is a perspective view of a two-sided socket mechanism of the invention, illustrated with a handle of a housing removed for clarity of illustration.
Figure 3:
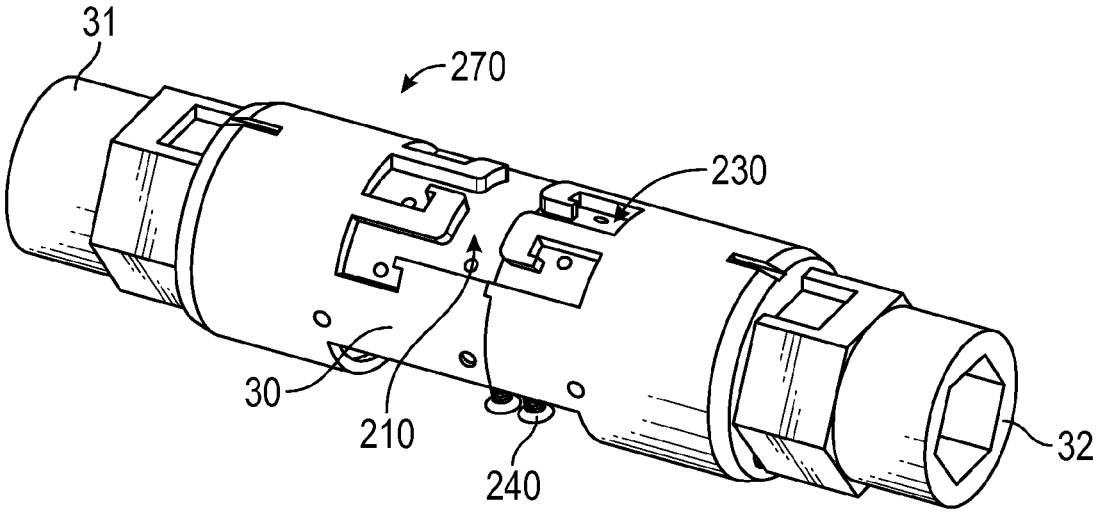
FIG. 3 is a top perspective view of FIG. 2, but with a collar omitted for clarity of illustration.
Figure 4:
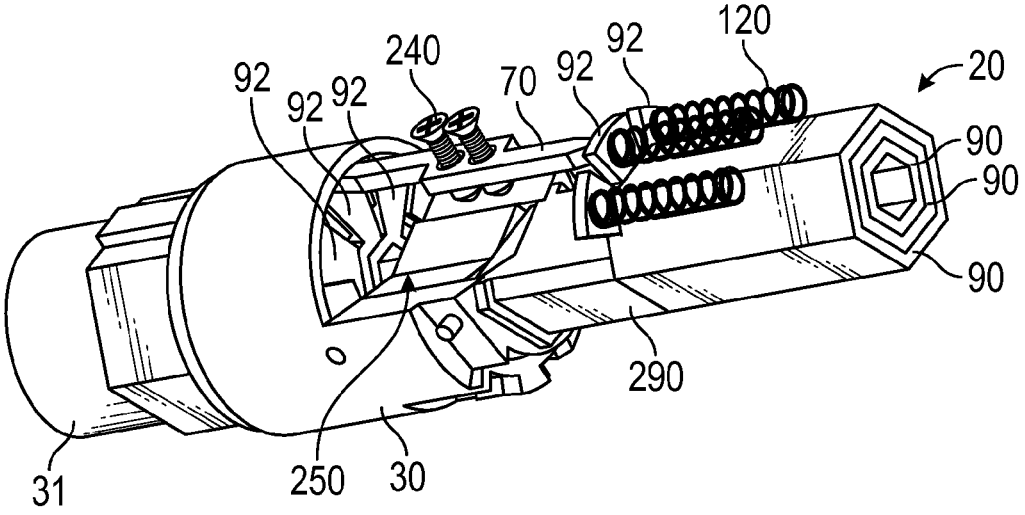
FIG. 4 is a perspective view of FIG. 3, but with a portion of the housing omitted to expose a foot and spring mechanism of each nested socket.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a nut driver 10 for driving a nut 15 within a range 20 (FIG. 4) of nut sizes all having a consistent perimeter shape 18. For example, the perimeter shape 18 may be a hexagon for driving a hexagonal nut 15, herein understood to refer to a nut, bolt, or other mechanical fastener. Alternately, the perimeter shape may be square (not shown), or any other suitable non-circular shape.

A rigid, elongated housing 30 has a first driver end 32 and a second handle end 38. The driver end 32 is open and assumes a largest size 29 of the perimeter shape 18, preferably a hexagon.

Figure 5A:
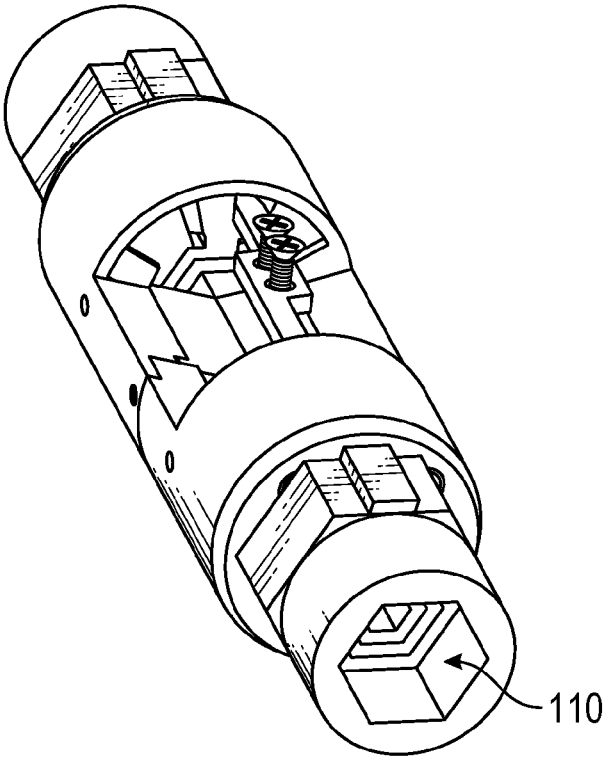
FIG. 5A is a front bottom perspective view of FIG. 3, illustrated with the plurality of sockets in their rearward positions.
Figure 5B:
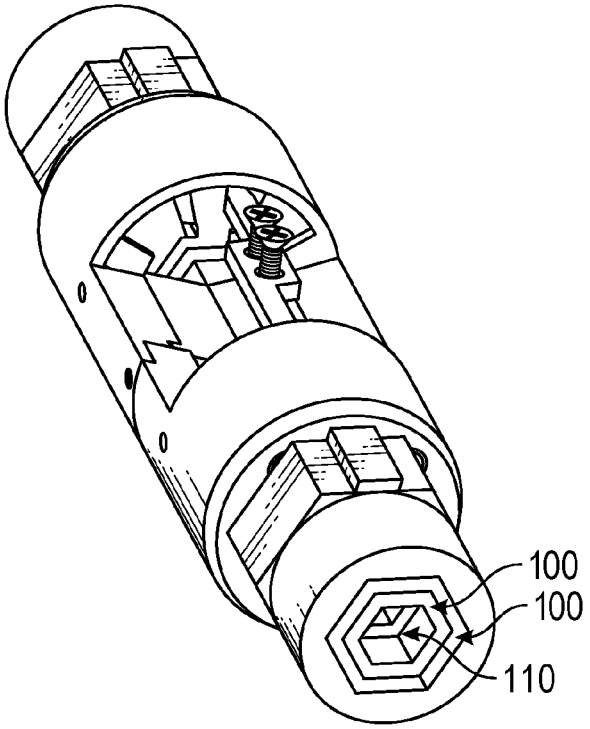
FIG. 5B is an enlarged perspective view of FIG. 5A, but with a plunger pushing two of the nested sockets into their forward positions.

A rigid collar 200 is fixed about the rigid housing 30 and positioned at any of a number of selectable radial positions 45, each of which is associated with a different nut size $S_n$ within the range of nut sizes 20, and positionable between a forward position 100 (FIG. 5B) and a rearward position 110 (FIG. 5A). In one embodiment, the collar 200 includes a high-friction grip 180 fixed with at least a portion of an outside surface 207 thereof.

A rigid plunger 70 is fixed with the collar 200, preferably with a pair of mechanical fasteners 240, and adapted to move between the forward position 100 and the rearward position 110 with the collar 200. Preferably the elongated housing 30 includes an open portion 250 opposite the guide channel 210 for receiving at least a portion of the plunger 70 therein.

Figure 6:
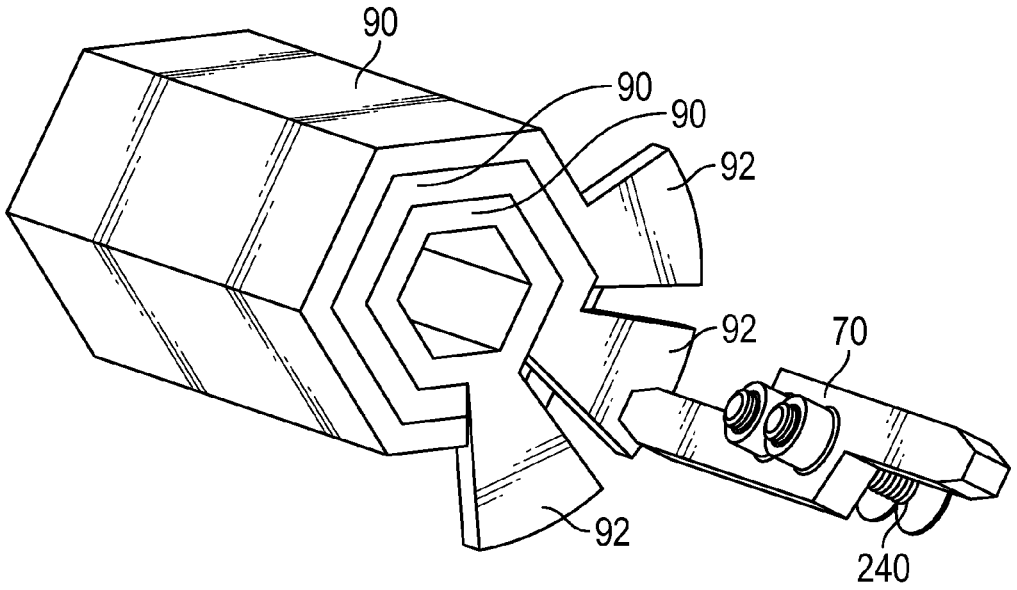
FIG. 6 is a partial, enlarged perspective view of three of the sockets and the plunger, illustrating the plunger selected on a middle of the three socket feet.

A plurality of nested sockets 90 each having the perimeter shape 18 and one of the different nut sizes $S_n$ within the range of nut sizes 20 are each slidably movable by the plunger 70 between the forward position 100 within the open end 32 of the housing 30, and the rearward position 110. Each socket 90 has a foot 92 adapted for contacting the plunger 70 at one of the selectable radial positions 45 (FIG. 6). Preferably the plurality of nested sockets 90 includes at least three nested sockets 90, as, for example, those associated with different nut sizes $S_1$=3/16", $S_3$=5/16" and $S_3$=7/16".

As such, as the collar 200 is turned from one of the selectable radial positions 45 to the next, the plunger 70 is aligned with the foot 92 of one of the sockets 90. When the collar 200 is then moved to the forward position 100 the plunger 70 pushes the one or more of the outermost nested sockets 90 into the forward position 100 within the open driver end 32 of the housing 30.

Figure 7:
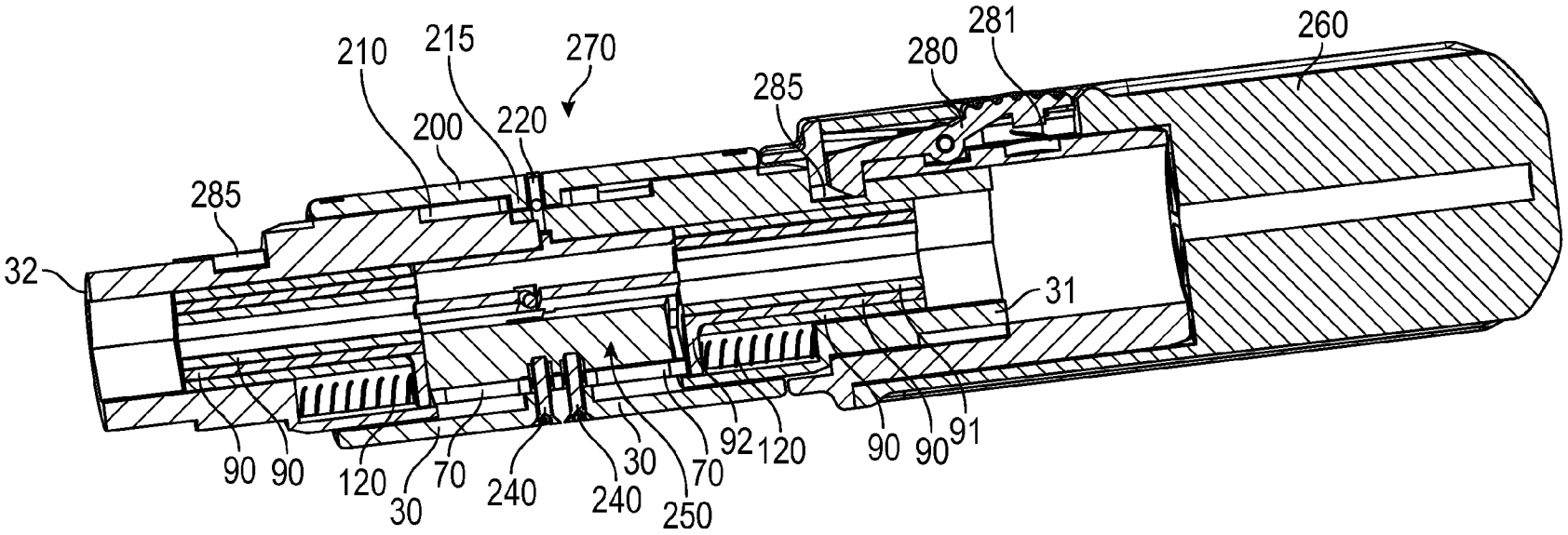
FIG. 7 is a cross-sectional view along the longitudinal axis of the fully-assembled nut driver.

A spring mechanism 120 is fixed with each of the sockets 90 and adapted to urge each of the sockets 90 into the rearward position 110. Further, the elongated housing 30 preferably includes a guide channel 210 for receiving for travel therein a guide tab 215 fixed with the collar. As such, the collar 200 is constrained to movement relative to the elongated housing by the guide channel 210. Such a guide channel 210 may include a J-shaped portion 230 associated with each socket 90, such that with the collar 200 set at one of the selectable radial positions 45 the guide tab 215 (FIG. 7) prevents movement of the collar 200 and associated socket 90 from moving into the rearward position 110, thereby locking the socket 90 into the forward position 100. The guide tab 215 may further include a spring-biased detent ball 220 for providing tactile feedback to the user when the collar 70 is in any of the selectable radial positions 45.

In a preferred embodiment, the elongated housing 30 is separated into two sections, including a handle 260 and a socket mechanism 270. The handle 260 is selectively detachable from the socket mechanism 270, the socket mechanism including the collar 200, plunger 70 and the plurality of nested sockets 90. The socket mechanism 270 further includes two opposing driver ends 32, such that the socket mechanism 270 may be positioned with either a first end 31 or the second end 32 engaged with the handle 260. Each of the two driver ends 31,32 includes sockets 90 having different nut sizes $S_n$, as, for example, those associated with different nut sizes $S_1$=3/16", $S_3$=5/16" and $S_3$=7/16" on one driver end 31, and those associated with different nut sizes $S_1$=1/4", $S_3$=3/8" and $S_3$=1/2" on one driver end 32.

In such an embodiment, preferably the handle further includes a spring-biased clip 280 (FIG. 7) that is selectively attachable to either end 31,32 of the socket mechanism 270 to fix the handle 260 to the socket mechanism 270. Such a spring-biased clip is of the type having a spring 281 that urges the spring-biased clip 280 into a recess 285 on either end 31,32 of the socket mechanism 270. Further, such an embodiment preferably includes the plunger 70 being two-sided for engaging sockets 90 of either of the two driver ends 31,32.

In such a two-sided embodiment, the forward position 100 of the collar 200, plunger 70 and sockets 90 of the first end 31 corresponds to the rearward position 110 of the collar 200, plunger 70 and sockets 90 of the second end 32. Alternately, the collar 200 and plunger 70 may be further positioned in a central, neutral position 105 (FIGS. 2 and 3), whereby the sockets 90 of both the first and second ends 31,32 are each urged by the spring mechanism 120 into their rearward positions 110 simultaneously.

While a particular form of the invention has been illustrated and described, it will be apparent that various modifications can be made without departing from the spirit and scope of the invention. For example, while six nested sockets 90 and plungers 70 are illustrated in the drawings, any suitable number could be used, such as two through twelve, for example. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A nut driver for driving a nut within a range of nut sizes all having a consistent perimeter shape, comprising:

a rigid, elongated housing having a first end and a second end, the driver first end being open and assuming a largest size of the perimeter shape, a collar mounted around the rigid housing and rotatably positionable and retained at any of a number of selectable radial positions about the longitudinal axis of the housing, each radial position associated with a different nut size within the range of nut sizes, and slidably positionable and retained between forward and rearward positions along the longitudinal axis of the housing;

a plunger fixed with the collar and adapted to move between a forward position and a rearward position with the collar;

a plurality of nested sockets each having the perimeter shape and one of the different nut sizes within the range of nut sizes, each slidably movable by the plunger between a forward position within the open first end of the housing and a rearward position, each socket having a foot adapted for contacting the plunger at one of the selectable radial positions;

whereby as the collar is turned from one of the selectable radial positions to the next, the plunger is aligned with the foot of one of the sockets, and when the collar is then moved to the forward position the plunger pushes the one or more of the outermost nested sockets into the forward positions within the open first end of the housing.

2. The nut driver of claim 1 further including a spring mechanism fixed with each of the sockets and adapted to urge each of the sockets into the rearward position.

3. The nut driver of claim 1 wherein the collar includes a high-friction grip fixed with at least a portion of an outside surface thereof.

4. The nut driver of claim 1 wherein the perimeter shape of the nut is a hexagon.

5. The nut driver of claim 1 wherein the plurality of nested sockets includes at least three nested sockets.

6. The nut driver of claim 1 wherein the elongated structure includes a guide channel for receiving therein a guide tab fixed with the collar, whereby the collar is constrained to movement relative to the elongated structure by the guide channel.

7. The nut driver of claim 6 wherein the guide channel includes a J-shaped portion associated with each socket, whereby with the collar set at one of the selectable radial positions the guide tab prevents movement of the collar and associated socket from moving into the rearward position, thereby locking the socket into the forward position.

8. The nut driver of claim 1 wherein the collar is fixed with the plunger with at least a pair of mechanical fasteners.

9. The nut driver of claim 6 wherein the elongated structure includes an open portion opposite the guide channel for receiving at least a portion of the plunger.

10. The nut driver of claim 1 further including a handle selectively detachable from the housing;

the second end being open and assuming a largest size of the perimeter shape on the second end and a second plurality of nested sockets, wherein the housing may be positioned with either a first end or a second end engaged within the handle, each of the first and second ends including sockets having different nut sizes from one another.

11. The nut driver of claim 10 wherein the handle further includes a spring-biased clip that is selectively engageable with either end of the housing to secure the handle to the housing.

12. The nut driver of claim 10 wherein the plunger is two-sided for engaging sockets of either of the first and second ends.

13. The nut driver of claim 10 wherein the collar and plunger may be further positioned in a central, neutral position whereby the sockets of both the first and second ends are each urged by a spring mechanism into their rearward positions.

14. The nut driver of claim 10 wherein the plurality of nested sockets of each of the first and second driver ends includes at least three nested sockets.

15. The nut driver of claim 10 wherein the elongated structure includes a guide channel for receiving therein a guide tab fixed with the collar, whereby the collar is constrained to movement relative to the elongated structure by the guide channel.

16. The nut driver of claim 15 wherein the guide channel includes a J-shaped portion associated with each socket, whereby with the collar set at one of the selectable radial positions the guide tab prevents movement of the collar and associated socket from moving into the rearward position, thereby retaining the socket in the forward position.

17. The nut driver of claim 10 wherein the collar is fixed with the plunger with at least a pair of mechanical fasteners.

18. The nut driver of claim 15 wherein the elongated structure includes an open portion opposite the guide channel for receiving at least a portion of the plunger.

* * * * *